United States Patent [19]

Makiyama et al.

[11] 4,012,346

[45] Mar. 15, 1977

[54] ACRYLIC SYNTHETIC FIBERS HAVING AN ANIMAL HAIR-LIKE TOUCH AND ITS METHOD OF MANUFACTURE

[75] Inventors: Muneto Makiyama, Akashi; Taizo Yasumoto, Takasago; Shoji Kumazawa, Takasago; Shoichi Murata, Takasago; Shiro Miya, Mino, all of Japan

[73] Assignee: Kanegafuchi Kagaku Kogyo Kabushiki Kaisha, Osaka, Japan

[22] Filed: June 3, 1975

[21] Appl. No.: 583,513

Related U.S. Application Data

[63] Continuation-in-part of Ser. No. 556,217, March 7, 1975, abandoned.

[30] Foreign Application Priority Data

Mar. 9, 1974 Japan ..... 49-27411
Mar. 9, 1974 Japan ..... 49-27412

[52] U.S. Cl. ..... 260/17 A; 264/182; 264/187

[51] Int. Cl.[2] ..... C08L 1/10

[58] Field of Search ..... 260/17 R; 264/182, 187

[56] References Cited

UNITED STATES PATENTS

| | | | |
|---|---|---|---|
| 2,591,368 | 4/1952 | McCarthy | 260/17 |
| 2,660,571 | 11/1953 | Ham | 264/182 |
| 3,051,545 | 8/1962 | Steuber | 264/182 |
| 3,380,423 | 1/1967 | Brown et al. | 260/17 |
| 3,751,332 | 8/1973 | Chen | 264/182 |
| 3,793,277 | 2/1974 | Thompson | 264/182 |
| 3,862,070 | 1/1975 | Fukushima | 264/182 |

OTHER PUBLICATIONS

Chem. Absts. 71:31319f, (1969), "Heat–Nonflammable–Chlorine Containing Synthetic Fibers," Kondo, et al.

*Primary Examiner*—Edward M. Woodberry
*Attorney, Agent, or Firm*—Armstrong, Nikaido & Wegner

[57] ABSTRACT

Acrylic synthetic fibers having excellent touch and luster properties are produced, wherein such fibers are prepared from a copolymer comprising 30 weight % or more of acrylonitrile, 70 weight % and less of vinyl chloride and/or vinylidene chloride and from 0 to 10 weight % of other polymerizable vinyl monomers. The copolymer also contains at least one metallic compound which is present in an amount of from 0.1 to 8.0 parts per 100 parts of copolymer and, additionally, at least one cellulose derivative which is present in an amount from 1.0 to 8.0 parts per 100 parts of the copolymer. Fibers produced from such copolymer have the touch and luster very similar to natural animal hair.

18 Claims, No Drawings

ACRYLIC SYNTHETIC FIBERS HAVING AN ANIMAL HAIR-LIKE TOUCH AND ITS METHOD OF MANUFACTURE

This is a continuation-in-part of our prior U.S. application Ser. No. 556,217 filed Mar. 7, 1975 and now abandoned.

DETAILED DESCRIPTION OF THE INVENTION

The present invention relates to acrylic synthetic fibers having an animal hair-like touch and to its method for production, and more particularly relates to acrylic synthetic fibers having an animal hair-like touch and lustre and, moreover, having a proper elongation and an easily tractable property in the finishing treatment of the fiber and to the method of production of the fiber, which is characterized in spinning a solution of an acrylic copolymer dissolved in an organic solvent, further containing one or more kinds of metallic compounds and cellulose derivatives.

Acrylic synthetic fibers have been hitherto considered to be fibers having a touch most similar to animal hair among many kinds of synthetic fibers from the standpoint of touch of fiber and easy treatment for fiber finishing and, accordingly, has been wisely applied in the field of imitation fur such as boa, seal and high pile modeled to animal fur. However, if the acrylic synthetic fiber is compared with the natural hair, it has a disadvantage on the wet and soft feeling which is the special or characteristic feeling of the natural hair. To overcome this disadvantage, post-treatment with a suitable treating agent has been utilized to date, however, the improvement has not yet been desirably obtained, since the treating agent gives a sticky feeling to the treated acrylic fibers. Furthermore, the effect of such a post-treatment has no durability to washing or dry-cleaning. Moreover, the post-treatment with such a treating agent has a bad effect on the spinning process of the treated acrylic fiber, since the separating property of fiber is decreased.

In order to improve these disadvantages mentioned above, the present inventors have made an extensive study and found that it is possible to obtain superior acrylic synthetic fibers having a nice touch and lustre with a similarity to animal hair which has not been previously anticipated and, moreover, having a proper elongation and an easy tractable property in the finishing treatment of fiber, by the spinning of a solution of an acrylic copolymer dissolved in an organic solvent, further containing one or more kinds of chosen metallic compounds and cellulose derivatives, and thus the present invention has been completed.

The copolymer used in the present invention consists of 30 weight % or more of acrylonitrile, 70 weight % and less of vinyl chloride and/or vinylidene chloride and 0 to 10 weight % of other polymerizable vinyl monomers. Particularly, those copolymers obtained from such monomeric mixtures which consist of 30 to 80 weight % of acrylonitrile, 70 to 20 weight % of vinyl chloride and/or vinylidene chloride and 0 to 10 weight % of other polymerizable vinyl monomers can be prepared to give superior acrylic synthetic fibers which are suitable for use as animal hair-like products, since they have a nice workability at a temperature easily retained for further finishing, have a proper elongation and a tractable property with a superior durability and, moreover, have a proper bending resistance very similar to animal hair. In cases where the content of the acrylonitrile component is less than 30 weight %, the dyeability of the obtained acrylic fibers decrease and the characteristic property of acrylic synthetic fibers of the acrylonotrile series disappears.

The other polymerizable vinyl monomer mentioned above and used in the present invention include, for example, acrylic acid ester, methacrylic acid ester, acrylic amide, methacrylic amide or mono- and di-alkyl derivatives of the said amides, styrene or $\alpha$ and $\beta$-derivatives of styrene, vinyl acetate, vinyl pyrrolidone, vinyl pyridine or alkyl derivatives of vinyl pyridine, acrylic acid, methacrylic acid, itaconic acid, p-styrene sulphonic acid, allyl sulphonic acid, methallyl sulphonic acid, paramethacryloyloxybenzene sulphonic acid, methacryloyloxypropyl sulphonic acid and metallic salts or amine salts of those acids mentioned above. The above mentioned co-polymers can be obtained by conventional polymerization methods using a polymerization initiator generally used in polymerization such as peroxide compounds, azo-compounds or various kinds of redox systems. A spinning solution is prepared by dissolving the obtained polymer in an organic solvent such as acetone, acetonitrile, dimethyl formamide, dimethyl sulfoxide, dimethyl acetamide and the like. Furthermore, if necessary, it is possible to add a stabilizer which is effective to improve such properties as anti-yellow change, light-resisting property and anti-weathering property.

Metallic compounds used in the present invention include silicon oxide ($SiO_2$), titanium oxide ($TiO_2$), zirconium oxide ($ZrO_2$), aluminium oxide ($Al_2O_3$), antimony oxide ($Sb_2O_3$), magnesium oxide ($MgO$), calcium oxide ($CaO$), zinc oxide ($ZnO$), tin oxide ($SnO$), titanium hydroxide ($Ti(OH)_4$), zirconium hydroxide ($ZrO(OH)_2$), aluminium hydroxide ($Al(OH)_3$), magnesium hydroxide ($Mg(OH)_2$), zinc hydroxide ($Zn(OH)_2$), aluminium phosphate ($AlPO_4$), calcium phosphate ($Ca_3(PO_4)_2$), calcium sulphate ($CaSO_4$), barium sulphate ($BaSO_4$), zinc sulphide ($ZnS$), basic lead carbonate ($2PbCO_3.Pb(OH)_2$) and di-basic lead phosphite ($2PbO.PbPHO_3.1/2H_2O$) and the like.

Cellulose derivatives used in the present invention include acetyl cellulose, acetyl propionyl cellulose, acetyl butyryl cellulose and the like.

The degree of acylation such as acetylation, etc. in cellulose derivatives mentioned above is chosen in the region where the cellulose derivatives are soluble in the solvent used for the preparation of co-polymer dope solution. For example, in the case where acetone is used for the solvent, the degrees are as follows:

- acetyl cellulose: the region of degree of acetylation is 37.0 to 43.2%
- acetyl propionyl cellulose: the region of degree of acetylation is 2.5 to 15.0% and that of propionylation is 30.0 to 45.0%,
- acetyl butyryl cellulose: the region of degree of acetylation is 1.6 to 29.5% and that of butyrylation is 17.0 to 53.0%.

Here, the observation of those degrees of acetylation, propionylation and butyrylation were carried out in accordance with the procedures of ASTM D-871 and D-817.

In the present invention, at least one of the metallic compounds described above are used in an amount in the range of from 0.1 to 8.0 parts per 100 parts of copolymer, and, preferably, 0.5 to 6.0 parts. In cases where less than 0.1 parts are used, no effect by the addition of metallic compounds can be found and in the case where more than 8.0 parts of the metallic compounds are used, undesirable effects result as to the mechanical properties of the obtained acrylic synthetic fibers and, moreover, the spinning properties of the prepared polymer solution decrease.

Further, in the present invention, at least one kind of cellulose derivative is used in an amount in the range of from 1.0 to 8.0 parts per 100 parts of copolymer and, preferably, 2.0 to 6.0 parts.

Since it is desirable to disperse the metallic compounds into a spinning solution in a manner as uniform as possible, a method is proposed for intimate mixing of the metallic compounds wherein the metallic compounds are, first, dispersed in an organic solvent containing a thickener for increasing its viscosity. Examples of the thickener include acrylic copolymer used in the present invention, homopolymers of glycidyl acrylate, glycidyl methacrylate, methyl acrylate or methyl methacrylate and copolymers of more than 30 weight % of glycidyl acrylate or glycidyl methacrylate and less than 80 weight % of other monomers which can copolymerize with the said glycidyl acrylate or glycidyl methacrylate such as methylacrylate, methyl methacrylate, vinyl acetate, acrylonitrile, vinyl chloride, vinylidene chloride, acrylic amide and the like.

After dissolving the thickener as mentioned above in an organic solvent such as acetone, acetonitrile, dimethyl formamide, dimethyl sulfoxide, dimethyl acetamide, etc. to prepare a solution whose viscosity is in a range of 5 to 1,000 cps and then adding metallic compounds of the present invention to the solution, the mixture is subjected to an agimixer, submicron, ball mill, vibration mill or sand grinder to obtain a stable and uniform dispersion. The uniformity of the dispersion solution provides stable spinning conditions for the spinning solution and, moreover, assists in obtaining desirable properties for the resulting acrylic fibers. The viscosity of the solution mentioned above was observed by using a viscometer of the VS type (manufactured by the Tokyo Measuring Instruments Co., Ltd.).

The desirable or characteristic features of the present invention are primarily due to the combined effect on the acrylic fiber of the said metallic compound and cellulose derivative which co-exist in the spinning solution of co-polymer. However, such desirable results are not obtained when either the metallic compound or cellulose derivative is used alone. As the result of this combined effect, the obtained acrylic synthetic fibers have the touch and lustre very similar to natural animal hair.

The basis for the combined effect resulting from the said combination can be explained in that natural animal hair, generally, has only a faint lustre on its surface which provides the appearance of so-called dead hair and has a special wet and soft feeling. Accordingly, in order to manufacture an animal hair-like synthetic fiber, attention must be called to these points.

In place of the present invention, when the metallic compound only is used in a spinning, solution, the synthetic fiber thus obtained is scant of transparency and lustre in the inner structure of the fiber and the surface of the fiber becomes rough and hard but still has its lustre on the surface of the fiber. On the other hand, when the cellulose derivative only is used, the decrease in lustre of the obtained synthetic fiber is scarcely noticed. However, in the case of using the said two kinds of compounds in combination, a synthetic fiber having deep wrinkles along the longitudinal axis of the fiber on its surface and having a considerable decrease in lustre is obtained. This is due to the different coagulating behavior of the polymeric composition in solution under spinning conditions. This appears to be the case when producing the desired fibers of the present invention, when considering the visual and tactile properties.

The second desirable or characteristic feature of the present invention is to be able to obtain an animal hair-like acrylic synthetic fiber, having a strong resistance to dry cleaning and washing and to retain its characteristic touch and appearance which is very similar to animal hair. It is to be emphasized that the desirable touch and appearance of the fibers of the present invention are not accomplished by a post-treatment of the surface of the fiber but are accomplished as the result of the synergistic effects of the two components, i.e., the metallic compound and cellulose derivative, which co-exist in the fiber itself.

The third characteristic feature of the present invention is the case of elongating the invented acrylic synthetic fiber during a polishing process of a piled knitting fabric for finishing and, moreover, the ease of handling the piled hair of the knitting fabric for the user.

The invention will be explained more definitely by way of the examples, however, the invention is not intended to be limited by such examples. In the following examples, parts and % mean weight parts and weight % respectively, unless otherwise indicated.

Further, in the examples, in order to get a fair and reliable evaluation on touch or feeling, which can be only determined by the human sense of touching, similar piled knitting fabrics were prepared under the same conditions and then evaluated by five judges depending only upon their sense of touch and feeling. Practically, each judge gave marks from 1 to 3 on every sample and those marks given by the five judges on every sample were added together each total mark being classified into three ranks according to the following standard.

| Total Mark | Standard for Evaluation | Rank |
|---|---|---|
| 13 – 15 | very similar to animal hair touch and feeling | high class |
| 9 – 12 | not so similar | middle class |
| 5 – 8 | further, not so similar | low class |

Further, the degree of lustre was determined using a measuring instrument, Type VG-107A, manufactured by Nippon Denshoku Sochi Co., Ltd. The sample for the measurement was carefully prepared in such a way that a definite amount of the obtained acrylic fiber was placed uniformly and stretched in a straight line on a surface of black mat paper of a given unit area. The incident beam of light was irradiated from an angle of 60° on the sample fiber and reflectance at 5 intervals from 0°–75° were observed. The lustre value of every sample was determined by the following relation and the degree of lustre of every sample was classified according to the following standard.

$$\text{Lustre Value} = \frac{(\text{max. reflectance} - \text{min. reflectance})}{(\text{min. reflectance})}$$

| Lustre Value | Standard for Evaluation | Rank |
|---|---|---|
| 0 – 2.5 | slight degree of lustre | high class |
| 2.6 – 4.9 | some degree of lustre | middle class |

-continued $$\text{Lustre Value} = \frac{(\text{max. reflectance} - \text{min. reflectance})}{(\text{min. reflectance})}$$

| Lustre Value | Standard for Evaluation | Rank |
|---|---|---|
| > 5.0 | lustrous | low class |

For the purposes of the present invention, the smaller the lustre value, the better the result.

EXAMPLE 1

1. At first, 100 parts of copolymer (whose specific viscosity of a cyclohexanone solution containing 2.0g of the polymer per liter of solution was 0.161 at 30° C) consisting of 32 parts of acrylonitrile, 67 parts of vinyl chloride and 1 part of sodium p-styrene sulfonate were dissoved in 400 parts of acetone to prepare a spinning solution (A-1).

Next, another acetone solution of the said copolymer was prepared, whose viscosity was 320 cps. Then, 100 parts of this solution was mixed with 20 parts of metallic oxides which were chosen for use in this example and the mixture was admixed in a submicron to prepare a stable suspension.

2. To 100 parts of the said copolymer in the spinning solution (A-1) prepared in (1), 2 parts of magnesium oxide, 0.8 parts of titanium oxide and 4 parts of acetylcellulose (having a degree of acetylation of 39.8%) were added and a spinning solution (A-2) was thus prepared.

3. To 100 parts of the said copolymer of the spinning solution (A-1), 2 parts of antimony oxide and 2 parts of acetyl butyryl cellulose (having a degree of acetylation of 29.5% and butyrylation of 17%) were added and thus a spinning solution (A-3) was prepared.

4. To 100 parts of the said copolymer in the spinning solution (A-1), 1 part of zirconium oxide and 1 part of zirconium hydroxide were added and thus spinning solution (A-4) was prepared.

Using the above-prepared spinning solutions, wet spinning was carried carried out through a nozzle of 0.08 mm $\phi \times 6{,}000$ holes into a coagulating bath consisting of a 40% aqueous solution of acetone at 30° C. Four kinds of acrylic synthetic fibers having a final denier of 3d were obtained, by stretching them into 3 times at 50° C in a 10% aqueous solution of acetone after the spinning, washing with water at 50° C and drying. Each of the fibers were prepared to a sliver and then knitted. Four kinds of piled knittings were manufactured through those treatments such as back-coating, shearing and polishing. The piled knittings were 20 mm of cut-length and 1 kg of weight/m² of fabric area. The observed results on touch and lustre are shown in Table 1.

Table 1

| | Spinning Solution | Metallic Compound (Part) | Cellulose-derivative (Part) | Touch Mark | Touch Class | Lustre Value | Lustre Class |
|---|---|---|---|---|---|---|---|
| Present Invention | A-2 | magnesium oxide (2) titanium oxide (0.8) | acetyl cellulose (4) | 14 | high | 1.7 | high |
| | A-3 | titanium oxide (2) | acetyl butyryl cellulose (2) | 13 | high | 1.4 | high |
| Reference Ex. | A-1 | — | — | 8 | low | 12.7 | low |
| | A-4 | zirconium oxide (1) zirconium hydroxide (1) | — | 6 | low | 3.2 | middle |

As it is clearly shown in Table 1, the combination of metallic compounds and cellulose derivatives co-exist in the spinning solution as in Examples A-2 or A-3 and provides superior properties as to touch and lustre of the obtained acrylic fiber as compared to those of the reference examples, A-1 and A-4.

EXAMPLE 2

1. At first, 100 parts of copolymer (whose specific viscosity of cyclohexanone solution containing 2.0g of the polymer per liter of solution was 0.234 at 30° C) consisting of 41 parts of acrylonitrile, 58 parts of vinyl chloride and 1 part of methacroyloxy-benzene sulphonic acid were dissolved into 300 parts of acetone and thus a spinning solution (B-1) was prepared.

Next, another acetone solution of the said copolymer was prepared (having a viscosity of 300 cps). Then, 100 parts of this solution was mixed with 80 parts of metallic oxides which were chosen for use in this example and the mixture was admixed in a ball mill to prepare a stable dispersion.

2. To 100 parts of the said copolymer of the spinning solution (B-1) prepared in (1), 2 parts of antimony oxide, 0.2 parts of silicon oxide and 5 parts of acetyl cellulose (having a degree of acetylation of 38.3%) were added and thus a spinning solution (B-2) was prepared.

3. To 100 parts of the said copolymer of the spinning solution (B-1), 2 parts of zinc oxide, 2 parts of aluminium hydroxide, 1 part of acetyl cellulose (having a degree of acetylation of 38.3%) and 3 parts of acetyl butyryl cellulose (having a degree of acetylation of 1.6% and butyrylation of 53%) were added and thus a spinning solution (B-3) was prepared.

Using the three kinds of acrylic synthetic fibers obtained from the said spinning solutions in the same way as explained in Example 1, three kinds of piled knittings were prepared and tested for touch after dry cleaning and washing. It was confirmed that the touch results of the knittings obtained from the fibers prepared from the spinning solutions (B-2) and (B-3) were very much superior to the fibers obtained from (B-1).

In this investigation, the dry cleaning was carried out, using perchlorethylene in the amount of 40 parts per one part of fabric, at 25° C for 30 minutes in a launder meter and the washing was carried out, using 5g/l of a washing agent and 40 parts of water per one part of fabric, at 40° C for 30 minutes in a domestic washing apparatus.

Table 2

| | Spinning Solution | Metallic Compound (Part) | Cellulose-derivative (Part) | Touch Before | Touch After* |
|---|---|---|---|---|---|
| Present Invention | B-2 | antimony oxide (2) silicon oxide (0.2) | acetyl cellulose (5) | 15 high | 14 high |
| | B-3 | zinc oxide (2) Aluminium hydroxide (2) | acetyl cellulose (1) acetyl butyryl cellulose (3). | 15 high | 15 high |
| Ref. Ex. | B-1 | — | — | 8 low | 8 low |

*Observed values after 5 times of dry cleaning

EXAMPLE 3

1. A spinning solution (C-1) was prepared by dissolving into 400 parts of acetone 100 parts of a copolymer (whose specific viscosity of cyclohexanone solution containing 2.0g of the copolymer per liter of solution was 0.253 at 30° C) obtained from a monomeric mixture of 50 parts of acrylonitrile, 49 parts of vinyl chloride and 1 part of sodium p-styrene sulfonate.

Next, an acetone solution was prepared containing a copolymer (whose specific viscosity of acetone solution containing 8.0g/l of solution was 0.02 at 30° C) consisting of 15 parts of acrylonitrile and 85 parts of glycidyl acrylate. Then, 50 parts of this solution (whose viscosity was 140 cps) was mixed with 50 parts of metallic compounds chosen for use in this example and the mixture was admixed in a ball mill to prepare a stable suspension.

2. To 100 parts of the said copolymer of the spinning solution (C-1), 0.5 parts of titanium oxide, 3 parts of zinc hydroxide and 3 parts of acetyl cellulose (having a degree of acetylation of 39.8%) were added and thus a spinning solution (C-2) was prepared.

3. To 100 parts of the copolymer of the spinning solution (C-1), 2 parts of basic lead carbonate and 1 part of acetyl propionyl cellulose (having a degree of acetylation of 2.5%, and propionylation of 45%) were added and thus a spinning solution (C-3) was prepared.

4. To 100 parts of the copolymer of the spinning solution (C-1), 0.05 parts of titanium oxide and 4 parts of acetyl cellulose (having a degree of acetylation of 39.8%) were added and thus a spinning solution (C-4) was prepared.

5. To 100 parts of the copolymer of the spinning solution (C-1), 0.05 parts of calcium oxide and 4 parts of acetyl cellulose (having a degree of acetylation of 40.5%) were mixed together and thus a spinning solution (C-5) was prepared.

6. To 100 parts of the copolymer of the spinning solution (C-1), 0.05 parts of tin oxide and 4 parts of acetyl cellulose (having a degree of acetylation of 37.8%) were mixed together and thus a spinning solution (C-6) was prepared.

7. To 100 parts of the copolymer of the spinning solution (C-1), 0.05 parts dibasic lead phosphite and 3 parts of acetyl cellulose (having a degree of acetylation of 39.8%) were mixed together and thus a spinning solution (C-7) was prepared.

From these spinning solutions, acrylic synthetic fibers were prepared in the same way as in Example 1. Then the touch and lustre of each piled knitting were examined as before. The obtained results are shown in Table 3.

Table 3

| | Spinning solution | Metallic Compound (Part) | Cellulose-derivative (Part) | Touch Mark Class | Lustre Value Class |
|---|---|---|---|---|---|
| Present Invention | C-2 | titanium oxide (0.5) zinc hydroxide (3) | acetyl cellulose (3) | 13 high | 1.5 high |
| | C-3 | basic lead carbonate (2) | acetyl propionyl cellulose (10) | 13 high | 2.0 high |
| Reference Example | C-4 | titanium oxide (0.05) | acetyl cellulose (4) | 11 middle | 6.0 low |
| | C-5 | calcium oxide (0.05) | acetyl cellulose (4) | 11 middle | 7.1 low |
| | C-6 | tin oxide (0.05) | acetyl cellulose (4) | 11 middle | 6.8 low |
| | C-7 | dibasic lead phosphite (0.05) | acetyl cellulose (3) | 9 middle | 7.0 low |

Though the touch and lustre of the fiber obtained from the spinning solution (C-3) are rather similar to those invented products in the present invention as seen in Table 3, the mechanical property of the fiber decreases rapidly with the increase of cellulose derivative contained in the housing solution of (C-3) type and accordingly, there is a question as to practical commercial use. In cases of spinning solutions (C-4), (C-5), (C-6) and (C-7), no sufficient effect can be found on the desired properties of the obtained fibers, since the amount of addition to metallic compound is too small in every case. In case of the present invention, since the spinning solution (C-2) contains metallic compounds and a cellulose derivative each in a proper amount, a sufficient effect on the desired properties of the obtained fiber can be clearly seen as shown in Table 3.

EXAMPLE 4

1. To 100 parts of the copolymer of the spinning solution (B-1) obtained in Example 2, 2 parts of antimony oxide and 6 parts of acetyl cellulose (having a degree of acetylation of 39.8%) were mixed together and this was used as a spinning solution (D-1).

2. To 100 parts of the copolymer of the spinning solution (B-1), 2 parts of zinc oxide, 3 parts of acetyl cellulose (having a degree of acetylation of 39.8%) and 3 parts of acetyl butyryl cellulose (having a degree of acetylation of 13% and butyrylation of 37%) were mixed together and this was used as a spinning solution (D-2).

3. To 100 parts of the copolymer of the spinning solution (B-1), 3 parts of titanium hydroxide, 1 part of an acetyl butyryl cellulose (having a degree of acetylation of 29.5% and butyrylation of 17%), 2 parts of an acetyl butyryl cellulose (having a degree of acetylation of 13% and butyrylation of 37%) and 3 parts of an acetyl butyryl cellulose (having a degree of acetylation of 6% and butyrylation of 48%) were mixed together and this was used as a spinning solution (D-3).

Touch and lustre properties of each of the obtained fibers were evaluated in the same way as in Example 1 and were confirmed to be sufficient to satisfy the purpose of the present invention, without any recognizable difference owing to the change of combination of cellulose derivatives.

EXAMPLE 5

1. A spinning solution (E-1) was prepared by dissolving into 400 parts of acetonitrile 100 parts of copolymer (whose specific viscosity of a dimethyl formamide solution containing 2.0g of polymer per liter of solution was 0.285 at 30° C) consisting of a mixture of 61 parts of acrylonitrile, 38.5 parts of vinyl chloride and 0.5 parts of sodium allyl sulfonate.

Further, 50 parts of an acetonitrile solution of the said copolymer (whose viscosity was 220 cps) was mixed with 60 parts of metallic compounds chosen for use in this example and the mixture was admixed in a ball mill to prepare a stable suspension containing the metallic compounds.

2. To 100 parts of the said copolymer dissolved in the spinning solution (E-1), 2 parts of antimony oxide, 0.2 parts of aluminium oxide and 3 parts of acetyl cellulose (having a degree of acetylation of 39.8%) were added and thus a spinning solution (E-2) was prepared.

3. To 100 parts of the said copolymer dissolved in the spinning solution (E-1), 5 parts of aluminium hydroxide and 3 parts of acetyl butyryl cellulose (having a degree of acetylation of 13% and butyrylation of 37%) were added and thus a spinning solution (E-3) was prepared.

Using the above spinning solutions, wet spinning was carried out through a nozzle of 0.08 mm $\phi \times 6{,}000$ holes in a 15% aqueous solution of acetonitrile at 20° C. Three kinds of acrylic synthetic fibers having a final denier of 3d were obtained, by stretching them after the spinning into 3 times at 20° C in a 75% aqueous solution of acetonitrile, washing with water and drying. Evaluations of the obtained piled knittings were carried out as in Example 1 and it was confirmed that such properties as touch and lustre of two kinds of acrylic fibers obtained from the spinning solutions (E-2) and (E-3) were very superior to those fibers of (E-1).

EXAMPLE 6

1. A spinning solution (F-1) was prepared by dissolving into 400 parts of dimethyl formamide 100 parts of copolymer (whose specific viscosity of dimethyl formamide solution containing 2.0g of polymer per liter of solution was 0.311 at 30° C) consisting of a mixture of 75 parts of acrylonitrile, 24 parts of vinyliden chloride and 1 part of sodium p-styrene sulfonate.

2. To 100 parts of the said polymer of the spinning solution (F-1), 1 part of titanium oxide, 3 parts of aluminium hydroxide and 4 parts of acetyl butyryl cellulose (having a degree of acetylation of 6% and butyrylation of 48%) were added and thus a spinning solution (F-2) was prepared.

3. To 100 parts of the said polymer of the spinning solution (F-1), 3 parts of magnesium hydroxide and 3 parts of acetyl cellulose (having a degree of acetylation of 38.3%) were added together and thus a spinning solution (F-3) was prepared.

Using the above-prepared spinning solution, wet spinning was carried out through a nozzle of 0.08 mm $\phi \times 6{,}000$ holes in a 50% aqueous solution of dimethyl formamide at 40° C. Three kinds of acrylic synthetic fibers having a final denier of 3d were obtained, by stretching them into 3 times at 50° C in a 20% aqueous solution of dimethyl formamide, washing with water and drying. Then, as in Example 1, evaluations of the prepared piled knittings were carried out. The obtained results are summarized in Table 4.

Table 4

| | Spinning solution | Metallic Compound (Part) | Cellulose-derivative (Part) | Touch Mark | Touch Class | Lustre Value | Lustre Class |
|---|---|---|---|---|---|---|---|
| Present Invention | F-2 | titanium oxide (1) aluminium hydroxide (3) | acetyl butyryl cellulose (4) | 14 | high | 1.4 | high |
| | F-3 | magnesium hydroxide (3) | acetyl cellulose (3) | 13 | high | 1.9 | high |
| Ref. Ex. | F-1 | — | — | 6 | low | 8.0 | low |

As it is seen from Table 4, the combination of metallic compounds and cellulose derivatives in the spinning solution make it possible to prepare an acrylic synthetic fiber having an animal hair-like touch or feeling.

EXAMPLE 7

1. A spinning solution (G-1) was prepared by mixing into 100 parts of the copolymer spinning solution (A-1) of Example 1, 2 parts of zinc sulphide, 1 part of calcium sulphate and 3 parts of acetyl cellulose (having a degree of acetylation of 37.8%).

2. A spinning solution (H-1) was prepared by adding 1.5 parts of zinc sulphide, 3.5 parts of barium sulphate and 4 parts of acetyl butyryl cellulose (having a degree of acetylation of 29.5% and butyrylation of 17%) into 100 parts of the copolymer spinning solution (B-1) prepared in Example 2.

3. A spinning solution (J-1) was prepared, dissolving into 400 parts of acetone 100 parts of a copolymer (whose specific viscosity of cyclohexanone solution containing 2.0g of the copolymer per liter of solution was 0.253 at 30° C) consisting of a mixture of 51 parts of acrylonitrile, 46 parts of vinyl chloride and 3 parts of methyl methacrylate. To 100 parts of the said copolymer contained in the spinning solution (J-1), 3 parts of aluminium phosphate, 2 parts of calcium phosphate and 3 parts of acetyl butyryl cellulose (having a degree of acetylation of 1.6 and butyrylation of 53.0%) were added together and thus a spinning solution (J-2) was prepared.

Using the above spinning solutions, wet spinning was carried out through a nozzle of 0.08 mm $\phi \times 6{,}000$ holes in a 30% aqueous solution of acetone at 30° C. Four kinds of acrylic synthetic fibers having a final denier of 3d were obtained, after stretching them into 3 times at 50° C in 10% aqueous solution of acetone, washing with water and drying. Using the prepared fibers, slivers were prepared and knitted. Finally, four kinds of piled knittings were manufactured by those treatments such as back-coating, shearing and polishing. The piled knittings were 20 mm of apparent cut-length and 1 kg of weight per m² of the fabric in the stage of shearing. In the following polisher process, each kind of piled knitting was finished repeatedly 3 times and 5 times on the cylindrical roll heated at 120° C, respectively. The observed length of pile is shown in Table 5.

Table 5

| | Spinning Solution | Metallic Compound (Part) | Cellulose-derivative (Part) | Length of Pile* 120° C × 3 times | Length of Pile* 120° C × 5 times |
|---|---|---|---|---|---|
| Present Invention | G-1 | zinc sulphide (2) calcium sulphate (1) | acetyl cellulose (3) | 0.95 | 0.97 |
| | H-1 | zinc sulphide (1.5) barium sulphate (3.5) | acetyl butyryl cellulose (4) | 0.99 | 1.00 |
| | J-2 | aluminium phosphate (3) calcium phosphate (2) | acetyl butyryl cellulose (3) | 0.97 | 0.98 |
| Ref. Ex. | J-1 | — | — | 0.87 | 0.91 |

Remark:
*the length of pile in the above table is the mean value of 50 observations and the comparative value to the value of H-1 pile finished polishing five times at 120° C being set 1.00.

From Table 5, it is seen that the length of pile in the present invention is rather long and the pile has a tendency to elongate easily.

EXAMPLE 8

1. Into 400 parts of dimethyl formamide were dissolved 100 parts of a copolymer (whose specific viscosity of dimethyl formamide solution containing 1.0g of the polymer per liter of solution was 0.161 at 25° C) consisting of 91 parts of acrylonitrile, 8 parts of methyl methacrylate and 1 part of sodium methallyl sulfonate and a spinning solution (K-1) was prepared.

Further, a copolymer (whose specific viscosity of cyclohexanone solution containing 2.0g of the polymer per liter of solution was 0.253 at 30° C) consisting of 50 parts of acrylonitrile, 49 parts of vinyl chloride and 1 part of sodium p-styrene sulfonate was dissolved into dimethyl formamide and a polymer solution was prepared (whose viscosity was 300 cps). Then, 50 parts of this solution as prepared and 60 parts of metallic compounds chosen for use in the present example were mixed together and the mixture was admixed in a ball mill to make a stable suspension.

2. To 100 parts of the copolymer of the spinning solution (K-1), 2 parts of magnesium oxide, 1 part of titanium oxide and 4 parts of acetyl cellulose (having a degree of acetylation of 39.8%) were added and thus a spinning solution (K-2) was prepared.

3. To 100 parts of the copolymer of the spinning solution (K-1), 2 parts of antimony oxide and 2 parts of acetyl butyryl cellulose (having a degree of acetylation of 29.5% and butyrylation of 17%) were mixed together and thus a spinning solution (K-3) was prepared.

4. A spinning solution (K-4) was prepared by adding 1 part of zirconium oxide and 1 part of zirconium hydroxide to 100 parts of the copolymer of the spinning solution (K-1).

Using the above spinning solutions, wet spinning was carried through a nozzle of 0.08 mm $\phi \times 6{,}000$ holes at 40° C in a 50% aqueous solution of dimethyl formamide. Four kinds of acrylic fibers having a final denier of 3d were obtained, after stretching them into three times in a 20% aqueous solution of dimethyl formamide at 50° C, washing with water and drying. Using these acrylic fibers, slivers were prepared and knitted. At last, four kinds of piled knittings were obtained, after back-coating the prepared knittings, shearing and polishing. Each of the obtained piled knittings was 20 mm in cut-length and 1 kg of weight per m² of fabric area. The observed results on touch and lustre of these piled knittings are summarized in Table 6.

Table 6

| | Spinning solution | Metallic Compound (Part) | Cellulose-derivative (Part) | Touch Mark | Touch Class | Lustre Value | Lustre Class |
|---|---|---|---|---|---|---|---|
| Present Invention | K-2 | magnesium oxide (2) titanium oxide (1) | acetyl cellulose (4) | 15 | high | 1.4 | high |
| | K-3 | antimony oxide (2) | acetyl butyryl cellulose (2) | 14 | high | 1.9 | high |
| Reference | K-1 | — | — | 7 | low | 8.1 | low |
| | | zirconium oxide (1) | | | | | |

Table 6-continued

| | Spinning solution | Metallic Compound (Part) | Cellulose-derivative (Part) | Touch Mark | Touch Class | Lustre Value | Lustre Class |
|---|---|---|---|---|---|---|---|
| Example | K-4 | zirconium hydroxide (1) | — | 6 | low | 3.6 | middle |

As it is clearly shown in Table 6, and invented product, such as obtained from the spinning solution (K-2) or (K-3), containing a combination of metallic compound and cellulose derivative, each in a definite amount, and has a nice touch and a lustre very similar to natural animal hair as compared with the case which lacks such a combination as in the spinning solution (K-1) or (K-4).

EXAMPLE 9

1. A spinning solution (L-1) was prepared by adding 2 parts of zinc sulphide and 6 parts of acetyl cellulose (having a degree of acetylation of 39.8%) to 100 parts of the copolymer contained in the spinning solution (K-1).

2. A spinning solution (L-2) was prepared by adding 1.5 parts of zinc sulphide, 3.5 parts of barium sulphate, 3 parts of acetyl cellulose (having a degree of acetylation of 39.8%) and 3 parts of acetyl butyryl cellulose (having a degree of acetylation of 13% and butyrylation of 37%) to 100 parts of the copolymer contained in the spinning solution (K-1).

3. A spinning solution (L-3) was prepared by adding 3 parts of aluminium phosphate, 0.5 parts of calcium phosphate, 1 part of an acetyl butyryl cellulose (having a degree of acetylation of 29.5% and butyrylation of 17%), 2 parts of an acetyl butyryl cellulose (having a degree of acetylation of 13% and butyrylation of 37%) and 3 parts of an acetyl butyryl cellulose (having a degree of acetylation of 6% and butyrylation of 48%) into 100 parts of the copolymer contained in the spinning solution (K-1).

4. A spinning solution (L-4) was prepared by adding 2 parts of zinc sulphide, 1 part of calcium sulphate, 1 part of an acetyl cellulose (having a degree of acetylation of 37.8%) and 2 parts of an acetyl cellulose (having a degree of acetylation of 40.5%) into 100 parts of the copolymer contained in the spinning solution (K-1).

Experimental evaluations as to touch were carried out in accordance with the procedures as in Example 1 and showed that all of the spinning solutions of the L-series produced a desirable acrylic fiber very similar to natural animal hair, regardless of the difference in the combination of cellulose derivatives.

What is claimed is:

1. Acrylic synthetic fibers having an animal hair-like touch, said fibers consisting essentially of A. A fiber forming copolymer consisting essentially of 30 or more weight % of acrylonitrile, 70 and less weight % of vinyl chloride and/or vinylidene chloride and 0 to 10 weight % of other polymerizable vinyl monomers, B. 0.1 to 8.0 parts of at least one metallic compound selected from the group consisting of $SiO_2$, $TiO_2$, $ZrO_2$, $Al_2O_3$, $Sb_2O_3$, MgO, CaO, ZnO, SnO, $Ti(OH)_4$, $ZrO(OH)_2$, $Al(OH)_3$, $Mg(OH)_2$, $Zn(OH)_2$, $AlPO_4$, $Ca_3(PO_4)$, $CaSO_4$, $BaSO_4$, ZnS, $2PbCO_3.Pb(OH)_2$ and $2PbO.PbPHO_3.1/2H_2O$, to 100 parts of the said copolymer and C. 1.0 to 8.0 parts of at least one cellulose ester to 100 parts of the said copolymer.

2. The acrylic synthetic fiber of claim 1 wherein the said copolymer comprises 30 to 80 weight % of acrylonitrile, 70 to 20 weight % of vinyl chloride and/or vinylidene chloride and 0 to 10 weight % of other polymerizable vinyl monomers.

3. The acrylic synthetic fiber of claim 1, the said other polymerizable vinyl monomers being at least one member selected from the group consisting of acrylic acid ester, methacrylic acid ester, acrylic acid amide, methacrylic acid amide or mono- or dialkyl derivatives of those amides, styrene and its $\alpha$ or $\beta$ substituted derivatives, vinyl acetate, vinyl pyrrolidone, vinyl pyridine and its alkyl-substituted derivatives, acrylic acid, methacrylic acid, itaconic acid, p-styrene sulphonic acid, allyl sulphonic acid, methallyl-sulphonic acid, p-methacryloyloxy-benzene sulphonic acid, methacryloyloxypropyl sulphonic acid or metallic salts or amine salts or such acids.

4. The acrylic synthetic fiber of claim 1, wherein the said cellulose derivatives are at least one cellulose derivative selected from the group consisting of acetyl cellulose, acetyl propionyl cellulose and acetyl butyryl cellulose.

5. The acrylic synthetic fiber of claim 1 wherein the amount of the said metallic compounds is present in the range of from 0.5 to 6.0 parts of 100 parts of the said copolymer.

6. The acrylic synthetic fiber of claim 1, wherein the amount of the said cellulose derivatives is present in the range of from 2.0 to 6.0 parts to 100 parts of the said copolymer.

7. A method of producing acrylic synthetic fiber having an animal hair-like touch, which is characterized by dissolving a fiber forming copolymer consisting essentially of 30 or more weight % of acrylonitrile, 70 and less weight % of vinyl chloride and/or vinylidene chloride and 0 to 10 weight % of other polymerizable vinyl monomers into an organic solvent to prepare spinning solution, adding 0.1 to 8.0 parts of metallic compounds selected from the group consisting of $SiO_2$, $TiO_2$, $ZrO_2$, $Al_2O_3$, $Sb_2O_3$, MgO, CaO, ZnO, SnO, $Ti(OH)_4$, $ZrO(OH)_2$, $Al(OH)_3$, $Mg(OH)_2$, $Zn(OH)_2$, $AlPO_4$, $Ca_3(PO_4)_2$, $CaSO_4$, $BaSO_4$, ZnS, $2PbCO_3.Pb(OH)_2$ and $2PbO.PbPHO_3.1/2H_2O$ and 1.0 to 8.0 parts of cellulose esters based on 100 parts of copolymer into the said copolymer solution, and spinning the prepared spinning solution.

8. The method of claim 7, wherein the said copolymer comprises 30 to 80 weight % of acrylonitrile, 70 to 20 weight % of vinyl chloride and/or vinylidene chloride and 0 to 10 weight % of other polymerizable vinyl monomers.

9. The method of claim 7 wherein the said other polymerizable vinyl monomers are at least one compound selected from the group consisting of acrylic acid ester, methacrylic acid ester, acrylic acid amide, methacrylic acid amide or mono- or di-alkyl derivatives of those amide, styrene and its $\alpha$ or $\beta$ substituted derivatives, vinyl pyrrolidone, vinyl pyridine and its alkyl substituted derivatives, acrylic acid, methacrylic acid, itaconic acid, p-styrene sulphonic acid, allyl sulphonic acid, methallylsulphonic acid, p-methacryloyloxy-benzene-sulphonic acid, methacryloyloxypropyl sulphonic acid or metallic salts or amine salts of such acids.

10. The method of claim 7, wherein the said cellulose derivatives are at least one cellulose derivative selected from the group consisting of acetyl cellulose, acetyl propionyl cellulose and acetyl butyryl cellulose.

11. The method of claim 7, the amount of the said metallic compounds is 0.5 to 6.0 parts to 100 parts of the said copolymer.

12. The method of claim 7 wherein the amount of the said cellulose derivatives is present in the range from 2.0 to 6.0 parts to 100 parts of the said copolymer.

13. The method of claim 7 wherein the said organic solvent is selected from the group consisting of acetone, acetonitrile, dimethyl formamide, dimethyl sulfoxide or dimethyl acetamide.

14. The method of claim 7 wherein the solvent is acetone and the degree of acylation of the cellulose derivatives are selected from the group consisting of Acetyl cellulose:
degree of acetylation . . . 37.0 – 43.2%
Acetyl propionyl cellulose:
degree of acetylation . . . 2.5 – 15.0%
degree of propionylation . . . 30.0 – 45.0%, and
Acetyl butyryl cellulose:
degree of acetylation . . . 1.6 – 29.5%
degree of butyrylation . . . 17.0 – 53.0%.

15. The method of claim 7, wherein the addition of the said metallic compounds is carried out in a procedure, wherein first, a thickener is dissolved in an organic solvent and the viscosity of the solution is adjusted to within a range of 5 to 1000 cps, second, the said metallic compounds are dispersed in the solution of thickener, and last, the thickener solution containing the metallic compounds is mixed together with a spinning solution.

16. The method of claim 15, wherein the said thickener is selected from the group consisting of an acrylic copolymer; homopolymers of glycidyl acrylate, glycidyl methacrylate, methyl acrylate or methyl methacrylate; copolymers containing more than 30 weight % of glycidyl acrylate or glycidyl methacylate and less than 70 weight % of a monomer which can copolymerize with the said glycidyl acrylate or glydicyl methacrylate, said monomers being selected from the group consisting of methylacrylate, methyl methacrylate, vinyl acetate, acrylonitrile, vinyl chloride, vinylidene chloride and acrylic amide.

17. The method of claim 15, wherein the organic solvent is selected from the group consisting of acetone, acetonitrile, dimethyl formamide, dimethyl sulfoxide and dimethyl acetamide.

18. The method of claim 15, wherein the dispersion of the metallic compound is carried out using an agi-mixer, submicron, ball mill, vibration mill or sand grinder.

* * * * *